US005632456A

United States Patent [19]

Krüger

[11] Patent Number: 5,632,456

[45] Date of Patent: May 27, 1997

[54] WINDER FOR WINDING A PAPER WEB INTO A ROLL

[75] Inventor: Jens Krüger, Heidenheim, Germany

[73] Assignee: Voith Sulzer Papiermaschinen GmbH, Heidenheim, Germany

[21] Appl. No.: 628,885

[22] Filed: Apr. 5, 1996

[30] Foreign Application Priority Data

Apr. 7, 1995 [DE] Germany ..... 195 13 143.6

[51] Int. Cl.[6] ..... B65H 18/14; B65H 18/26

[52] U.S. Cl. ..... 242/541.5; 242/541.6; 242/542

[58] Field of Search ..... 242/541.5, 541.6, 242/541.7, 542

[56] References Cited

U.S. PATENT DOCUMENTS

| | | | |
|---|---|---|---|
| 4,180,216 | 12/1979 | Dahl et al. | 242/541.5 |
| 5,499,779 | 3/1996 | Randaskoski | 242/542 X |

FOREIGN PATENT DOCUMENTS

| | | |
|---|---|---|
| 94850118.4 | 6/1994 | European Pat. Off. . |
| 2239778 | 2/1974 | Germany . |
| 3035652A1 | 4/1982 | Germany . |
| 9115481.2 | 12/1991 | Germany . |
| 4112536A1 | 10/1992 | Germany . |

*Primary Examiner*—John Q. Nguyen
*Attorney, Agent, or Firm*—Taylor & Associates, P.C.

[57] ABSTRACT

A winder for winding a traveling paper web into a paper roll. Two support drums include respective longitudinal axes which extend substantially parallel to each other. Two nip rolls include respective longitudinal axes which extend substantially parallel to the longitudinal axes of the support drums. A support body carries the two nip rolls. The two nip rolls are pivoted when the paper roll has a particular diameter, such that the two nip rolls define an essentially sealed space with the support body and a portion of a shell surface of the paper roll. A vacuum port is disposed in communication with the sealed space.

20 Claims, 6 Drawing Sheets

WINDER FOR WINDING A PAPER WEB INTO A ROLL

BACKGROUND OF THE INVENTION

1. Field of the Invention

The present invention relates to a winder for winding a traveling web, such as a paper web, into a roll.

2. Description of the Related Art

In the winding of webs, the winding hardness, or tightness, plays a major role in view of subsequent processing. Especially with paper webs it is quite decisive for the winding tightness to have a certain progression over the entire paper roll diameter. The winding tightness should generally decline from a certain starting value to an ending value. The decline should be maximally uniform from the first to the last ply. It should have a certain gradient, that is, should not be too heavy and not too little. Most of all, the winding tightness should not involve any jump, for instance a sudden drop.

This is accomplished only through specific measures. When doing nothing, the line pressure between the paper roll and the drum(s) becomes ever greater with increasing paper roll diameter, and thus also the winding tightness.

To avoid this, e.g., so-called rider rolls are used, which are arranged axially parallel to the drums and serve to exert a nip on the paper roll. The nip is controlled to be high at the start and diminishes with increasing paper roll weight. Thus, the rider roll allows influencing the line pressure and with it also the winding tightness, controlling it in the desired sense. When forming a paper roll with a very large diameter is desired, also the line pressure is very high in the end phase of winding. The winding tension increases as well, giving rise to web burst or crepe wrinkles.

Other measures to influence the winding tightness consist in distributing the load of the paper roll to the individual drums. For that purpose, drums of equal diameter were arranged already at different horizontal planes, or drums of different diameters were used. Moreover, it is known that winding with a drum of smaller diameter produces a tighter winding than is obtained with a drum of larger diameter.

DE-U1-91 15 481 shows and describes a winder for web-to-roll winding with a relieving device for application of compressed air on the shell surface of the paper roll. Employed is a blowing space formed of the two bed rolls of the winder, a partitioning wall that bridges the clearance between the shell surfaces of the two drums, of two end walls and of the shell surface of the paper roll itself.

EP 0 631 954 A2 shows and describes a bed roll winder with two drums. It employs a pressure-tight space that encloses the entire paper roll and has walls which approach in the bed roll area their shell surfaces and are sealed at that point. Application of a vacuum at the sealed space, or partial spaces, allows exerting a corresponding force on the paper roll, thereby relieving it more or less of its deadweight, so that thereafter a floating of the paper roll on the drums may come about.

SUMMARY OF THE INVENTION

The present invention provides a winder which at large paper roll diameters, and consequently heavy paper roll weights, reduces an effective line force between the drums and the paper roll, and at that, with a minimum structural expense.

The invention comprises, in one form thereof, a winder for winding a traveling paper web into a paper roll. Two support drums include respective longitudinal axes which extend substantially parallel to each other. Two nip rolls include respective longitudinal axes which extend substantially parallel to the longitudinal axes of the support drums. A support body carries the two nip rolls. The two nip rolls are pivoted when the paper roll has a particular diameter, such that the two nip rolls define an essentially sealed space with the support body and a portion of a shell surface of the paper roll. A vacuum port is disposed in communication with the sealed space.

The present invention provides the following non-exclusive advantages:

Application of a more or less strong vacuum on the pressure-tight space composed of support body, nip rolls, shell surface of the paper roll and appropriate end walls makes it possible to achieve a sensitive adjustment of the bearing pressure between paper roll and drums.

Accomplished is furthermore that the space below the two drums is kept free of built-ins such as pneumatic relief boxes. The advantage thereof is that the space can be used easily in terms of engineering for arrangement of cut-off devices, for instance cut-off blades introduced from below in between the two drums, so as to sever the paper web upon completion of a paper roll at a point located somewhere in the upper triangle between the two drums.

The seal is a very simple one. The introduction of the core, at the start of the winding operation, in the triangle between the drums is in no way hindered thereby.

Unlike the relief by means of pressure, the application of a vacuum does not risk the trapping of air between the outermost ply and the following ply of the paper roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 2:
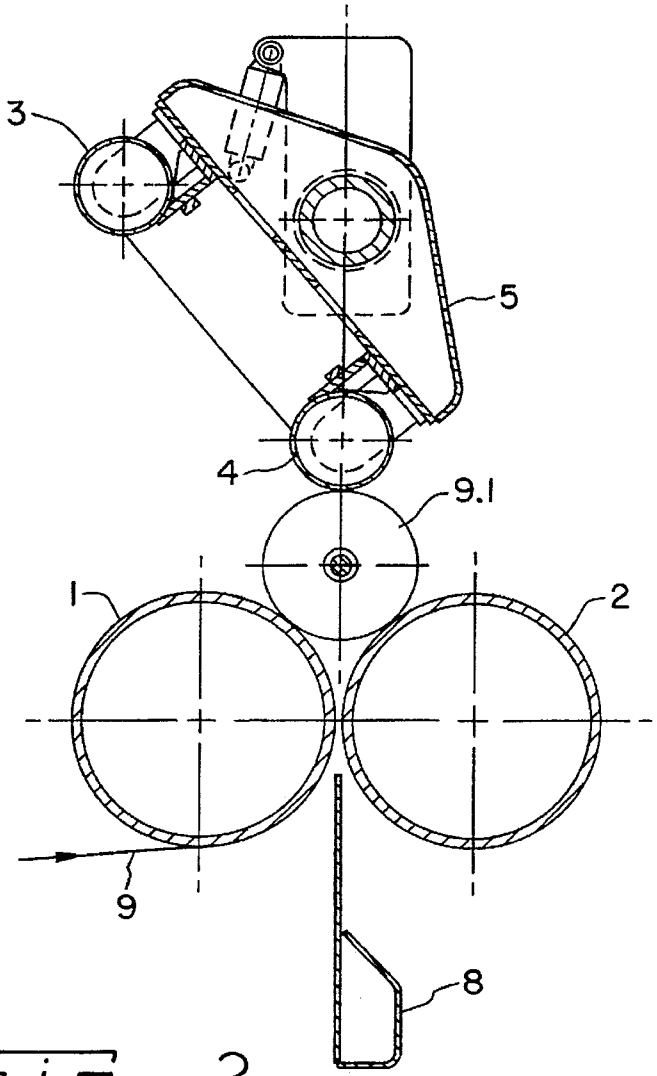
FIGS. 1–4 illustrate an embodiment of a winder according to the present invention in various phases of a winding operation.

Depicted in FIGS. 1–4 are two drums 1 and 2, two nip rolls 3 and 4, and as one of the very essential components, a support body 5 which supports the two nip rolls 3 and 4. Support body 5 possesses on its two ends an axle journal 5.1 each. The two axle journals 5.1 are fitted each in vertical direction in a guide rail 6. A pivoting unit 7 is hinged, for one, to the guide rail 6 and, for another, to the support body 5. It goes without saying that such a pivoting unit 7 is located on both sides of the winder. Lastly, support body 5 features on its two ends a partition 5.2 each, which will be discussed in more detail below.

The winder includes a cut-off device 8, which is illustrated here only very schematically. Cut-off device 8 is introduced from below in the triangle between the two drums 1, 2 and has in its upper area a blade (not illustrated in detail).

Figure 1:
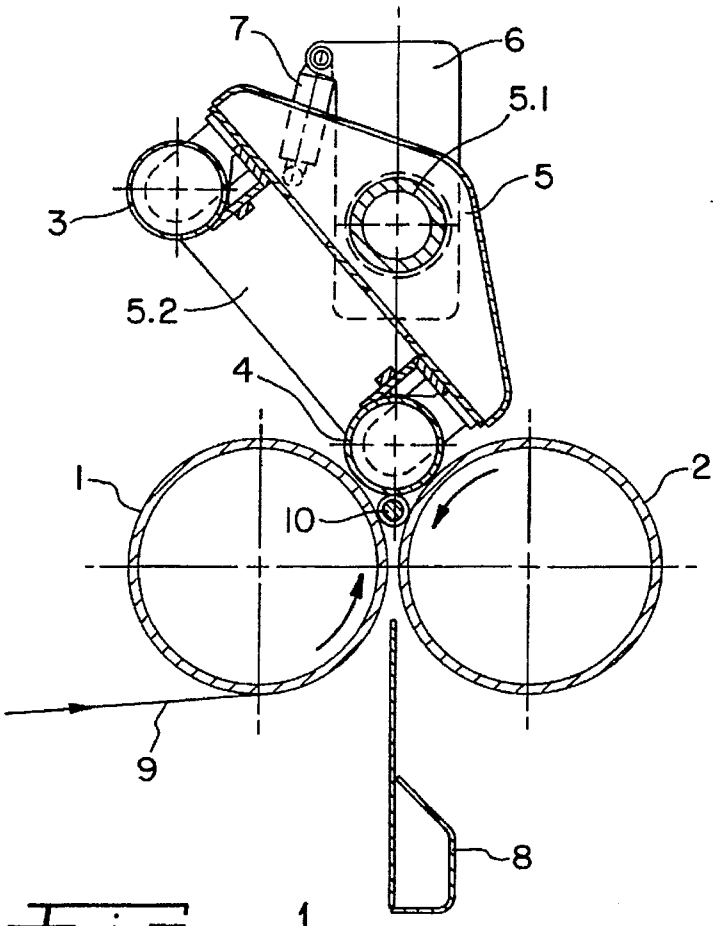

In the embodiment shown, a paper web 9 approaches the winder from below and, to begin with, wraps around drum 1. Visible in FIG. 1 is a core 10, on which the web 9 is being wound. In the winding phase shown in FIG. 1, the leader of paper web 9 has just been attached to the core 10, so that the winding operation may begin. Support body 5 has at that time been pivoted already to a position such that the nip roll 4 bears on the core, respectively the growing paper roll, exerting on it a certain pressure.

In the phase of the winding operation illustrated in FIG. 2, paper roll 9.1 has now grown somewhat larger. Support body 5 is still in an inclined position, and nip roll 4 still exerts pressure on the paper roll 9.1, although somewhat reduced in accordance with the increased weight of paper roll 9.1. The load is adjustable by means of a hydraulic unit 20; refer to FIG. 5. Of course, the load can be controlled automatically across the diameter of paper roll 9.1.

Figure 3:
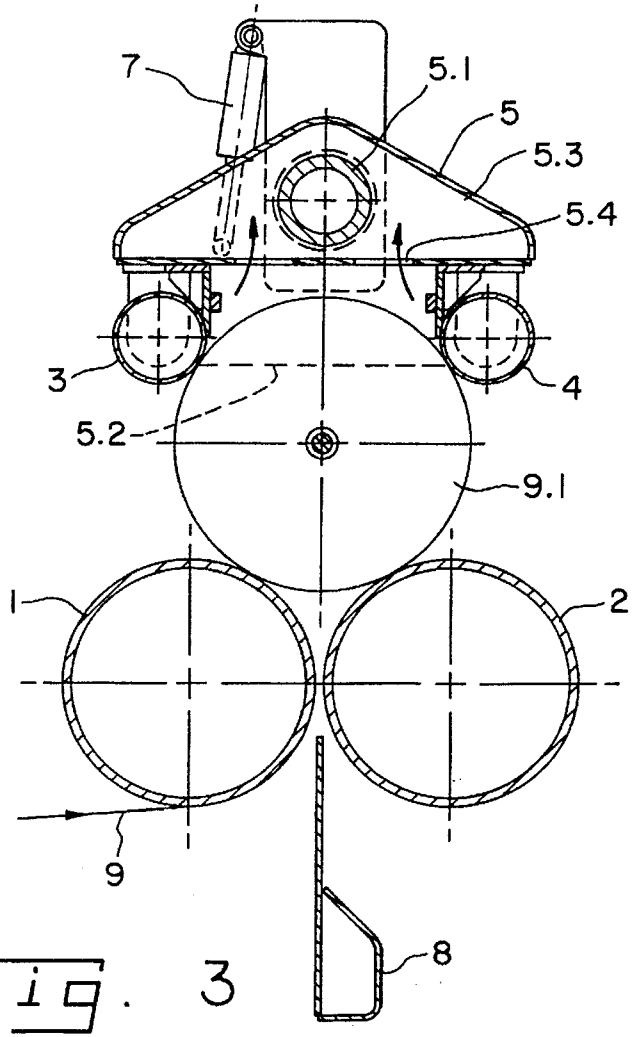

In the winding phase illustrated in FIG. 3, paper roll 9.1 has a considerably larger diameter and, consequently, also an appreciably greater weight. Pivoting unit 7 was used to pivot the support body 5 in a position such that the shell surfaces of the two nip rolls 3, 4 bear on paper roll 9.1 in sealing fashion. Created thereby is a sealed space bounded by part of the shell surface of the paper roll 9.1, parts of the shell surfaces of nip rolls 3, 4 as well as by support body 5 itself, including its end walls 5.2.

Continued loading can now be transmitted for a certain time yet by means of nip rolls 3 and 4 on paper roll 9.1. At a certain point in time, however, the weight of the paper roll 9.1 will be so heavy that further load on the roll is no longer desirable at all, but, on the contrary, relief is desired to reduce the bearing pressure between paper roll 9.1 and the two drums 1, 2 gradually. From now on, the two nip rolls 3, 4 serve no longer for the application of pressure, but to establish a seal. Applying now a vacuum on the sealed space causes the relief to take place, since the vacuum tends to lift the paper roll 9.1 off the two drums 1, 2.

Support body 5 may be fashioned in its upper area as a suction box 5.3 with appropriate perforations 5.4 to establish a communicating connection to the sealed space. Suction box 5.3 contains in this case the vacuum port. The vacuum port of suction box 5.3 may be passed through one of axle journals 5.1, which is the case presently, or also through both axle journals 5.1.

Figure 4:
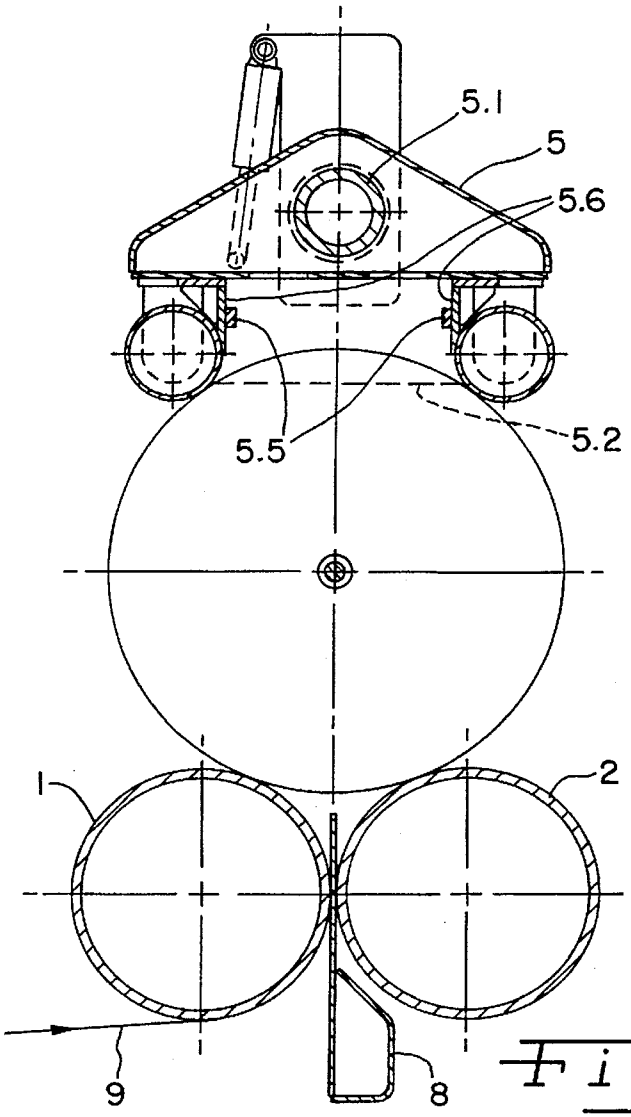

FIG. 4 depicts the state in which paper roll 9.1 approaches its completion. Support body 5 is merely located at a higher level in accordance with the larger diameter of paper roll 9.1. Visible are the two guides 5.5 for the sealing end walls 5.2 as well as lengthwise sealing plates 5.6.

Figure 5:
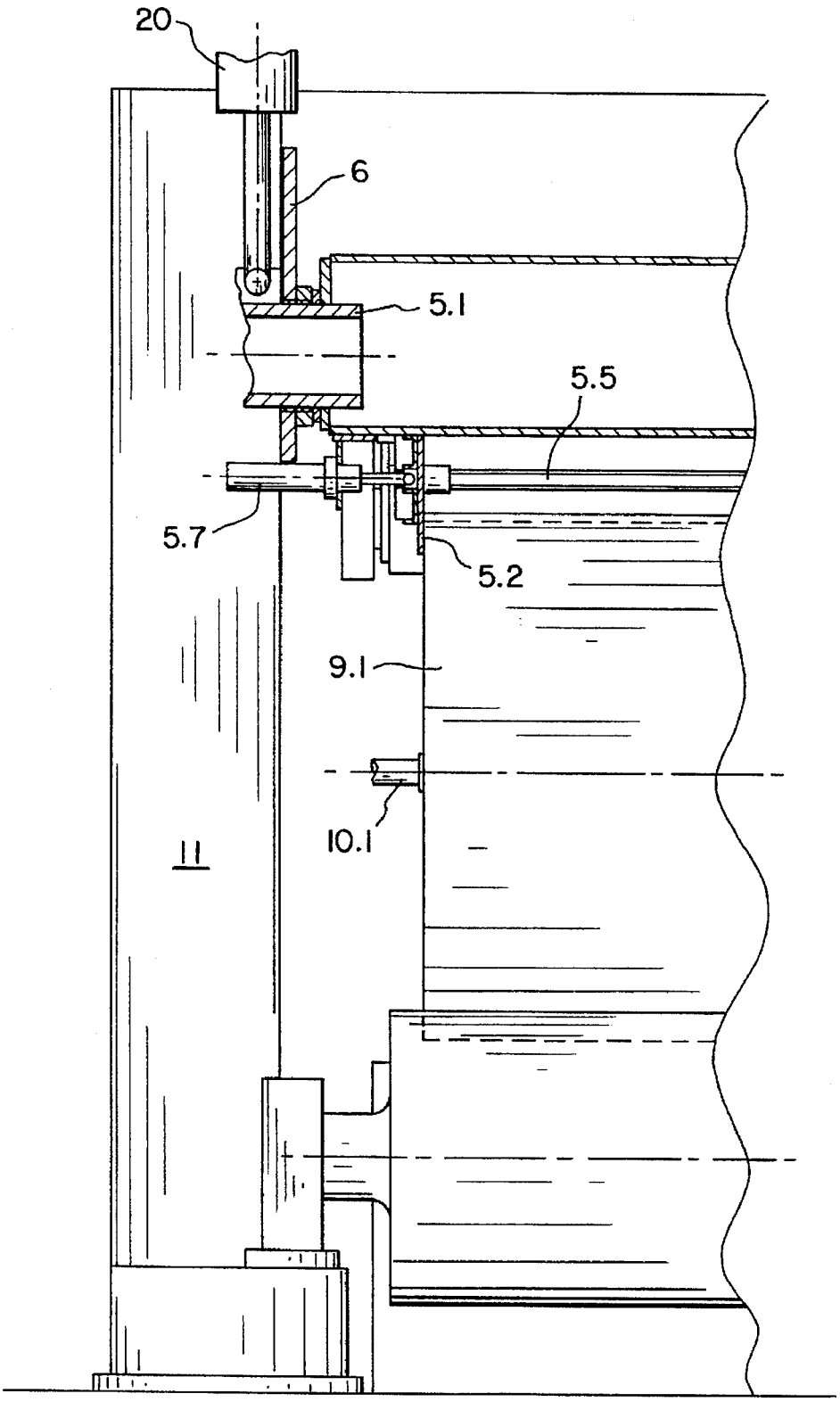
FIG. 5 is a side, sectional view through FIG. 4.

FIG. 5 is a side, sectional view through FIG. 4 showing details presented previously, such as part of the hydraulic unit 20, the hollow axle journal 5.1 serving as a suction journal or vacuum port, its longitudinal axis being likewise the pivotal axis of support box 5. Visible also is one of the two end sealing walls 5.2 of support box 5. The two end walls 5.2 are positioned, e.g., by means of a cylinder 5.7 near the end faces of paper roll 9.1, thereby creating a sealing effect. Additionally provided is a guide 5.5 for the two end walls 5.2. A core guide 10.1 is provided for the core 10; and the assembly is fitted in a column 11.

Figure 6:
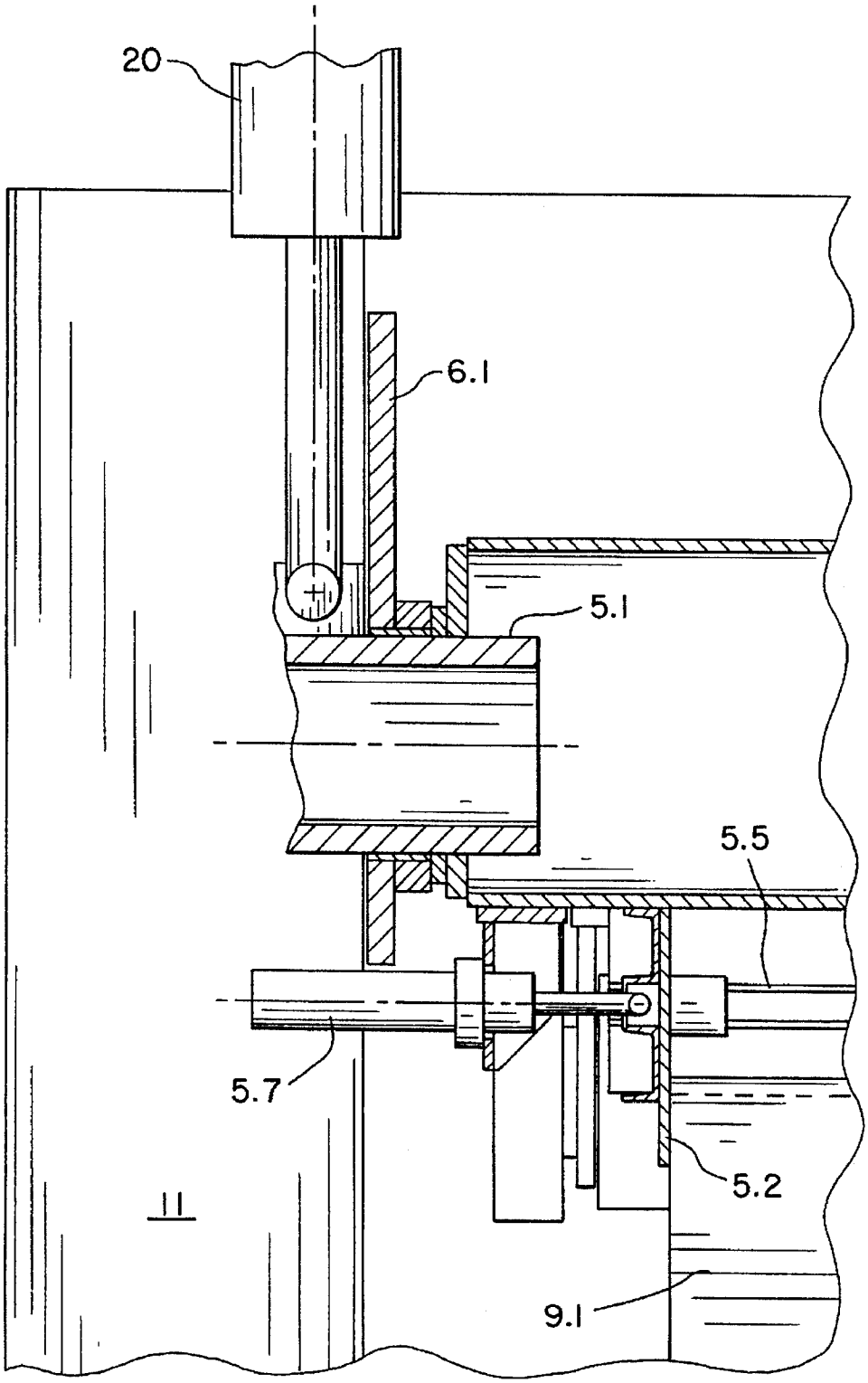
FIG. 6 is an enlarged, fragmentary view of FIG. 5.

FIG. 6 is an enlarged, fragmentary view of FIG. 5.

Figure 7:
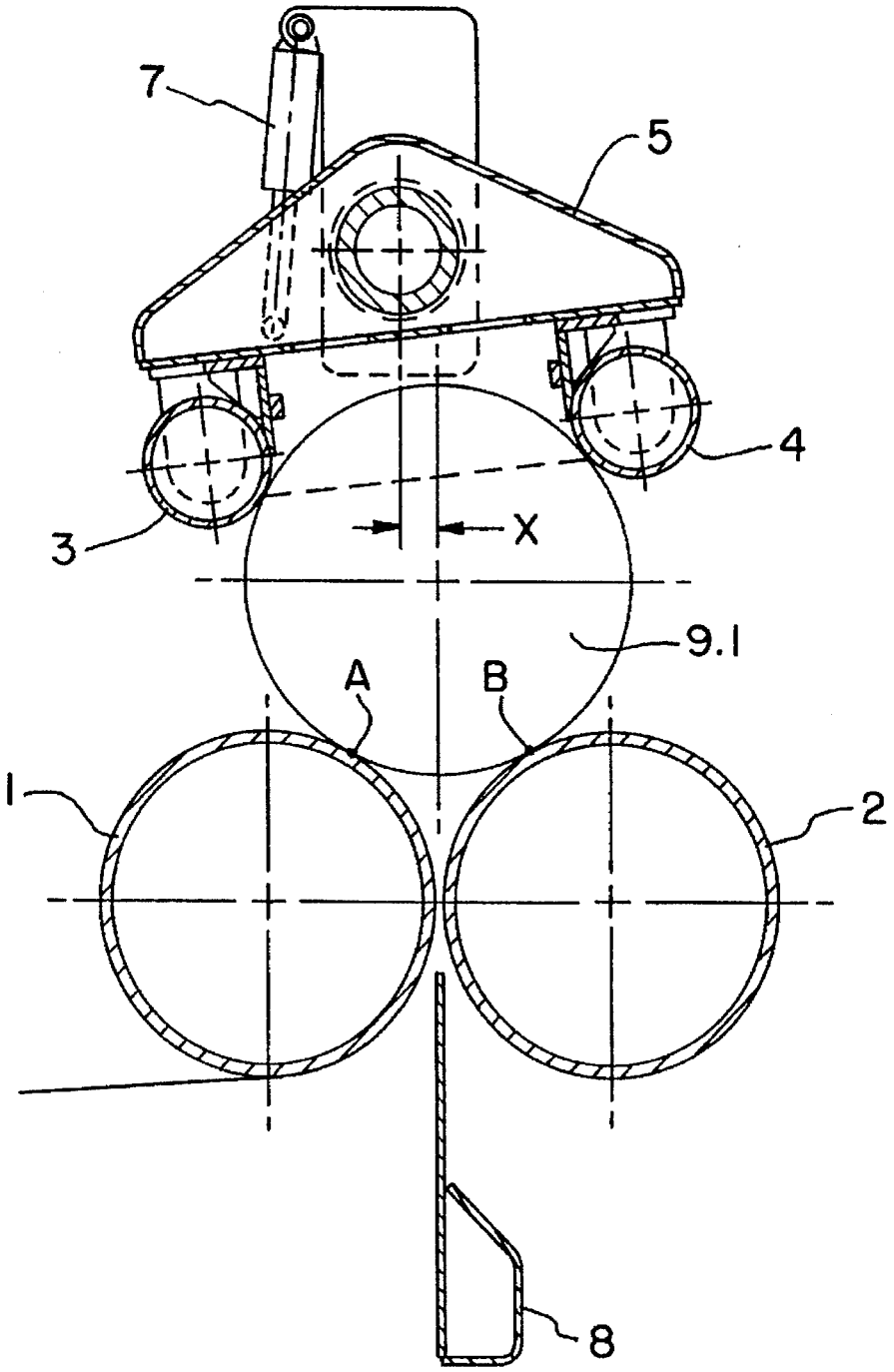
FIG. 7 illustrates another embodiment of a winder according to the present invention.

FIG. 7 illustrates another embodiment of a winder according to the present invention. The pivotal axis of support body 5 is offset here in horizontal direction by the amount x in relation to the axis of paper roll 9.1. This makes it possible to establish different bearing forces at points A and B of drums 1 and 2.

Figure 8A:
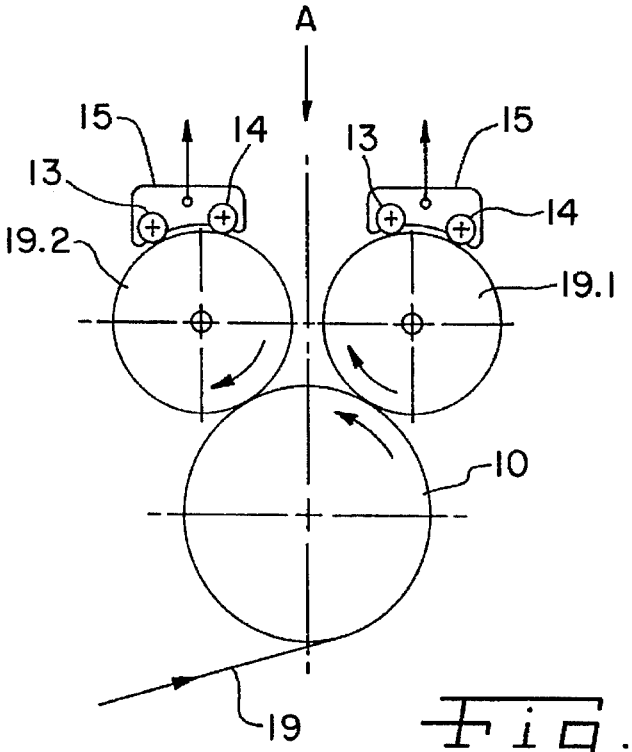
FIGS. 8*a* and 8*b* schematically illustrate a side elevation view and pertaining plan view of an embodiment a winder according to the present invention in a so-called drum roll slitter.
Figure 8B:
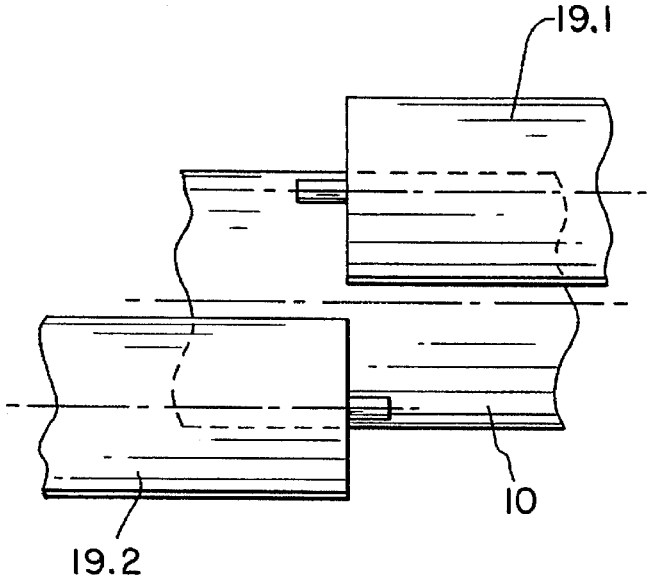

FIGS. 8*a* and 8*b* illustrate in a side elevation and pertaining plan view the application of the invention in a so-called drum roll slitter. As opposed to the preceding embodiments, this machine features only a single drum, namely support drum 10. A paper web 19 approaches drum 10 from below, wraps around it along part of its path and is then—not illustrated here—slit in a number of strips by appropriate length slitting devices, and is wound into a plurality of rolls, of which here only rolls 19.1 and 19.2 are shown.

Assigned to each paper roll 19.1 and 19.2, also in this embodiment, are two nip rolls 13, 14 with their axes extending parallel to the drum 10. Also provided is a support body 15 in which the two nip rolls 13, 14 are fitted and which jointly with the nip rolls 13, 14 as well as with part of the shell surface of the respective paper roll is able to form a sealed space, once the paper roll has assumed a certain diameter. This space is equipped with a vacuum port. The structure of nip rolls 13, 14 as well as support body 15 and the inventionally relevant associated structure is identical or similar to the embodiment described above using two drums 1, 2.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A winder for winding a traveling paper web into a paper roll, comprising:

two support drums having respective longitudinal axes which extend substantially parallel to each other;

two nip rolls having respective longitudinal axes which extend substantially parallel to said longitudinal axes of said support drums;

a support body carrying said two nip rolls;

means for pivoting said two nip rolls when the paper roll has a particular diameter, such that said two nip rolls define an essentially sealed space with said support body and a portion of a shell surface of the paper roll; and a vacuum port disposed in communication with said sealed space.

2. The winder of claim 1, further comprising a drive for moving said support body relative to said two drums.

3. The winder of claim 2, wherein said drive loads said two nip rolls onto the paper roll.

4. The winder of claim 1, wherein said support body includes an axis extending substantially parallel to a longitudinal axis of the paper roll, said support body being pivotable about said support body axis.

5. The winder of claim 1, wherein said support body includes an axle journal at each end thereof, said support body pivotable about said axle journals; and further comprising at least one fluid actuated drive associated with said support body for adjusting a pivotal orientation of said support body and loading said two nip rolls onto the paper roll.

6. The winder of claim 5, further comprising a pair of guides for respectively carrying said axle journals.

7. The winder of claim 6, wherein each said fluid actuated drive is pivotally connected to one of said guides.

8. The winder of claim 5, wherein said fluid actuated drive comprises a hydraulic drive.

9. The winder of claim 5, wherein at least one of said axle journals includes said vacuum port.

10. The winder of claim 1, further comprising a hydraulic drive pivotally connected to said support body and configured for applying a load to said support body.

11. A winder for winding a traveling paper web into at least one paper roll, comprising:

at least one support drum having a longitudinal axis;

at least one pair of nip rolls respectively associated with each paper roll to be wound, each said pair of nip rolls having respective longitudinal axes which extend substantially parallel to said longitudinal axis of each said support drum;

a support body associated with and carrying at least one said pair of nip rolls;

means for pivoting each said pair of nip rolls when the associated paper roll has a particular diameter, such that each said pair of nip rolls define an essentially sealed space with said support body and a portion of a shell surface of the associated paper roll; and at least one vacuum port respectively disposed in communication with said sealed space of each said pair of nip rolls.

12. The winder of claim 11, further comprising a drive for moving said support body relative to said two drums.

13. The winder of claim 12, wherein said drive loads at least one said pair of nip rolls onto the paper roll.

14. The winder of claim 11, wherein said support body includes an axis extending substantially parallel to a longitudinal axis of the paper roll, said support body being pivotable about said support body axis.

15. The winder of claim 11, wherein said support body includes an axle journal at each end thereof, said support body pivotable about said axle journals; and further comprising at least one fluid actuated drive associated with said support body for adjusting a pivotal orientation of said support body and loading at least one said pair of nip rolls onto the paper roll.

16. The winder of claim 15, further comprising a pair of guides for respectively carrying said axle journals.

17. The winder of claim 16, wherein each said fluid actuated drive is pivotally connected to one of said guides.

18. The winder of claim 15, wherein said fluid actuated drive comprises a hydraulic drive.

19. The winder of claim 15, wherein at least one of said axle journals includes said vacuum port.

20. The winder of claim 11, further comprising a hydraulic drive pivotally connected to said support body and configured for applying a load to said support body.

* * * * *